United States Patent [19]

Clark

[11] 4,349,048

[45] Sep. 14, 1982

[54] PIPE THREAD PROTECTOR

[75] Inventor: Jim W. Clark, Houma, La.

[73] Assignee: Superior Casing Crews, Inc., Metairie, La.

[21] Appl. No.: 217,415

[22] Filed: Dec. 17, 1980

[51] Int. Cl.[3] ..... B65D 59/00; F16L 57/00

[52] U.S. Cl. ..... 138/96 T; 138/96 R; 308/4 A

[58] Field of Search ..... 138/89, 96 R, 96 T, 138/99, 110, 178; 308/4 R, 4 A; 166/241, 315; 24/259 R, 259 FS, 259 RC, 16 R, 16 PB, 20 R, 20 TT, 24

[56] References Cited

U.S. PATENT DOCUMENTS

| | | | |
|---|---|---|---|
| 2,167,235 | 7/1939 | Engstrom | 138/96 T |
| 2,628,134 | 2/1953 | Williams et al. | 308/4 A |
| 3,038,502 | 6/1962 | Hauk et al. | 138/96 T |
| 3,240,232 | 3/1966 | Matherne | 138/96 T |

*Primary Examiner*—James E. Bryant, III

*Attorney, Agent, or Firm*—Harvey B. Jacobson

[57] ABSTRACT

A protector for easy and quick installation on and removal from the threaded end of a pipe, such as well casing or tubing, when making up a string of well casing or tubing for insertion into a well bore. The protector includes a tension belt constructed in a manner to resiliently bias the protector toward open position with the ends of the tension belt being interconnected by a latching device having an integral handle associated therewith with the tension belt being encapsulated by a resilient body to protect the threads of the pipe. The latching device and associated handle structure is recessed into the body and related housing structure so that no components project beyond the periphery of the resilient body. The handle structure includes a unique undercut portion enabling the finger or fingers to move the operating end of the handle outwardly of the body and also a hook structure for engagement over an inclined guy wire for gravity movement of the protector back to a point adjacent the pipe rack for attachment to a section of casing or tubing to be moved from the pipe rack into position for connection with a joint of casing already in the well bore. The resilient body of the protector is constructed of a readily distinguishable color and provided with rounded corners to enable it to more easily slide over objects or obstructions.

8 Claims, 6 Drawing Figures

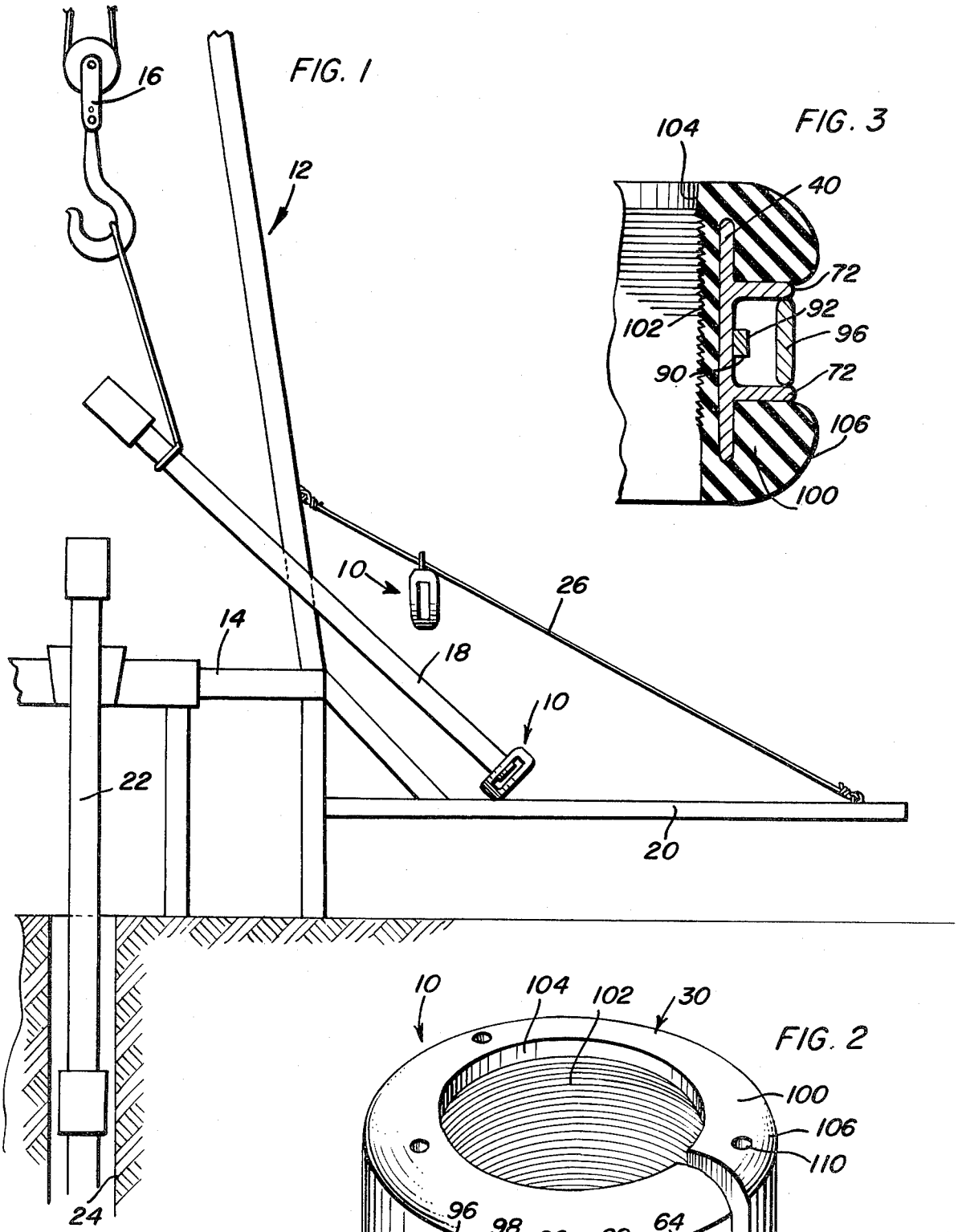
FIG. 1
16
12
10
26
14
18
10
22
20
24
FIG. 3
104
40
72
92
102
96
90
72
106
100
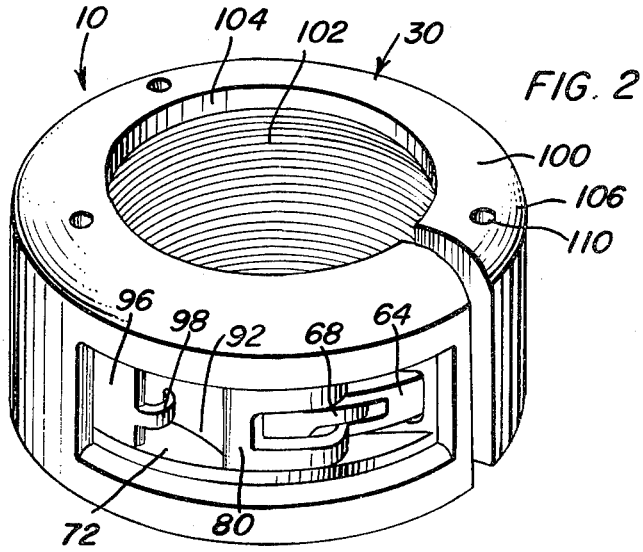
FIG. 2
10
104
102
30
100
106
110
96
98
92
68
64
72
80

FIG. 4
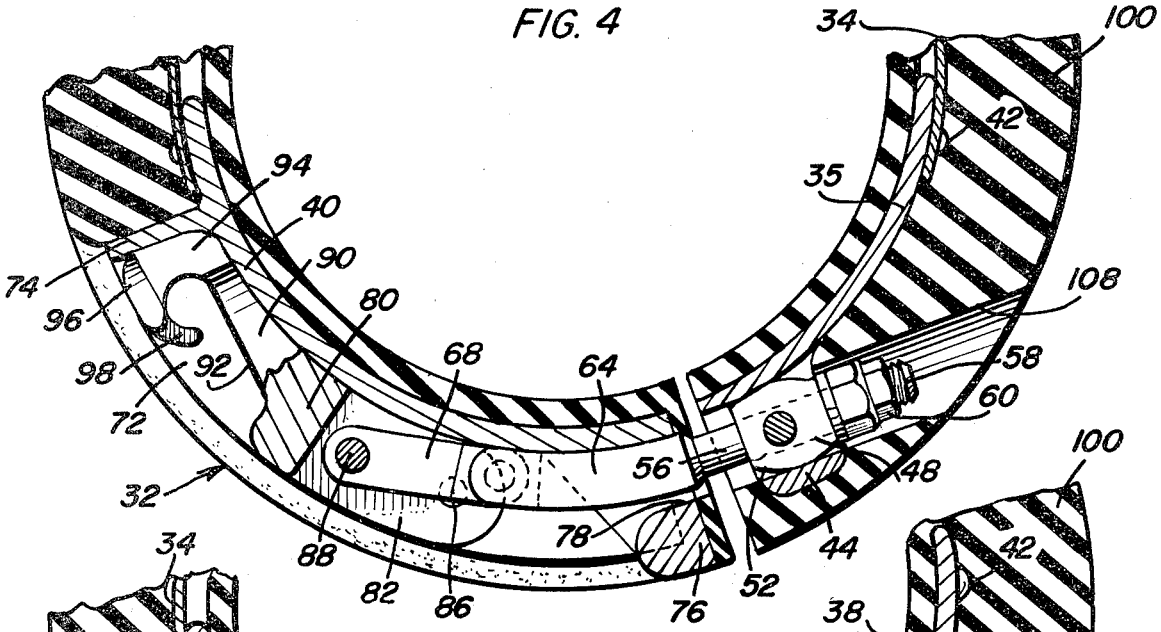
FIG. 5
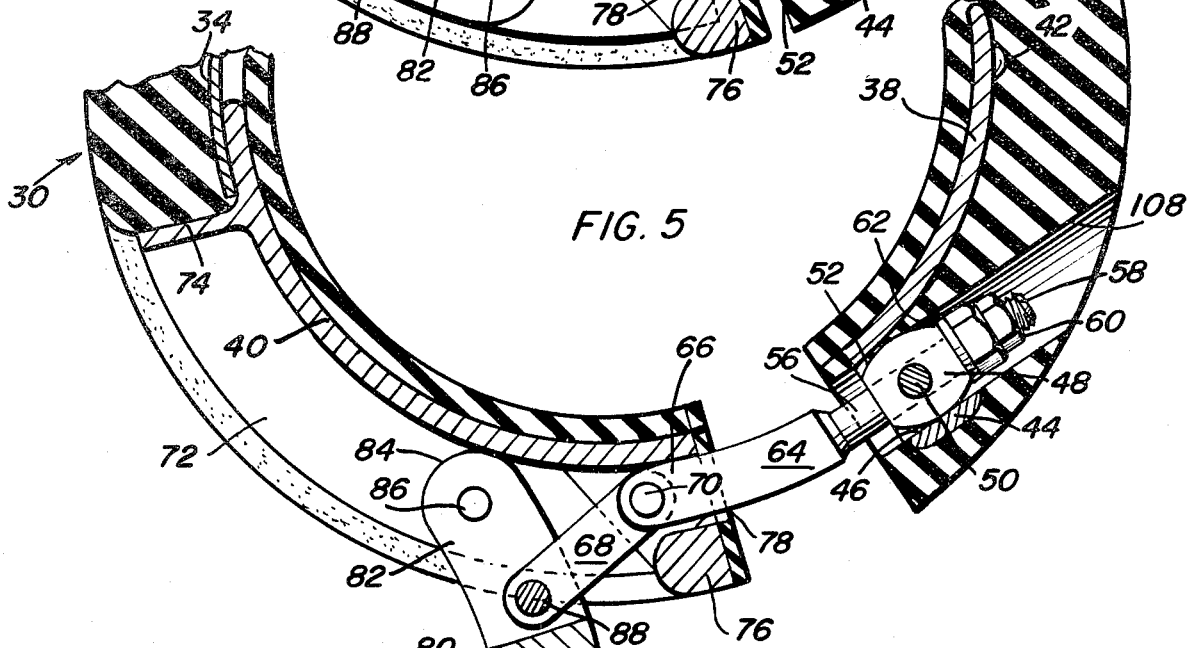
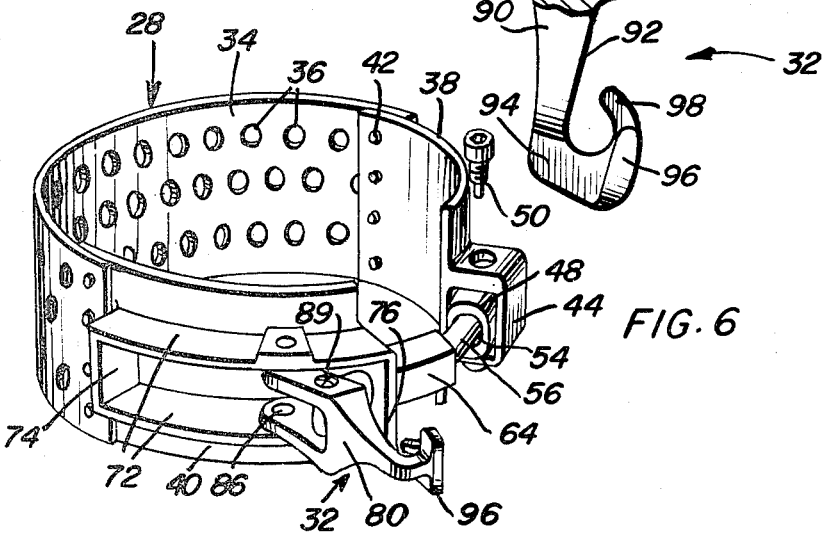
FIG. 6

PIPE THREAD PROTECTOR

BACKGROUND OF THE INVENTION

1. Field of the Invention

The present invention generally relates to a thread protector andmore specifically a protector for the threaded ends of a well casing or tubing joint such as those used in oil wells, and the like, with the protector including unique structural features enabling it to be easily installed on and removed from the threaded end of the pipe in a safe and efficient manner without the use of any special tools with the protector effectively protecting the threads while enabling the interior of the pipe to be gauged by a driftable gauging member being moved through the pipe joint, by gravity, without interference from the thread protector.

2. Description of the Prior Art

U.S. Pat. No. 3,240,232, issued to carrol J. Matherne on Mar. 15, 1966, discloses a thread protector which generally includes a tension belt, a latching structure interconnecting the ends of the tension belt and a body of resilient material associated with the tension belt and latching structure so that the protector may be mounted on the threaded end of a pipe and the pipe can be gauged by a drift gauge in a well-known manner. This type of thread protector has been in use in the oil well field for some time. U.S. Pat. No. 3,038,502 issued to Ernest D. Hauk et al on June 12, 1962, discloses another thread protector having generally the same components as the above-mentioned patent except that the latching device is cam operated and includes a handle structure extending diametrically of the pipe on which the protector is mounted. U.S. Pat. No. 4,036,261, issued to Ernest D. Hauk on July 17, 1977, discloses another type of thread protector which is pneumaticaly operated. Other prior patents relating to thread protectors are listed in the above-mentioned patents. While such devices have been utilized in the oil fields for a number of years, it is desirable that such protectors be improved to render them more economical, easier to use, safer to use, more effective for their purposes and longer lasting when in use.

SUMMARY OF THE INVENTION

An object of the present invenion is to provide a thread protector for the threaded end of a casing or tubing joint which enables the pipe to be drift gauged without interference by the thread protector when it is installed on the pipe, casing or tubing with the protector including a tension belt that is spring biased toward the open position thereby eliminating the necessity of holding the thread protector open when removing it from the casing or installing it on the casing.

Another object of the present invention is to provide a thread protector which is safe in operation inasmuch as opening the latching device to remove the thread protector does not require that the person performing this function place his hand and arm between casing joints with the installation and removal of the protector requiring no tools or other equipment under normal conditions with a person being able to install or remove the protector by using only his hands.

A further object of the invention is to provide a thread protector in accordance with the preceding objects in which the latching structure is quick acting and providing with a flange under which a person may easily place their fingers to open the latching device and thread protector.

Still another object of the invention is to provide a thread protector constructed of corrosion resistant metallic components and a chemically resistant resilient body having a high visibility red color to provide a long lasting, dependable and efficiently handled thread protector.

These together with other objects and advantages which will become subsquently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic elevational view illustrating the manner of use of the thread protector of the present invention in association with a casing joint and oil well rig.

FIG. 2 is a perspective view of the thread protector.

FIG. 3 is a transverse sectional view of the thread protector illustrating the relationship of the resilient body to the tension belt, plates and housing for the latching device.

FIG. 4 is a horizontal sectional view through a portion of the thread protector illustrating the latching device in closed position.

FIG. 5 is a sectional view similar to FIG. 4 but illustrating the latching device in open position.

FIG. 6 is a perspective view of the tension belt, housing plates and latching device in open condition.

DESCRIPTION OF THE PREFERRED EMBODIMENT

Referring now specifically to the drawings, the thread protector of the present invention is generally designated by reference numeral 10 and in FIG. 1 it is illustrated in use in relation to an oil well drilling or servicing rig 12 having a drilling or servicing platfrom 14 and a travelling block 16 by which joints 18 of casing or tubing are moved from a pipe storage rack 20 into vertical position in the rig 12 for connection to a string of casing or tubing 22 already oriented in a well bore 24 in a conventional and well-known manner to those skilled in this art with the thread protector of the present invention being disposed on the pin or externally threaded end of the casing or tubing joint 18 while it is slid along the pipe rack 20 and platform 14 and adjacent inclined surface areas which could result in damage to the threads if the thread protector 10 does not stay in position thereon. When the thread protector 10 is removed from the casing or tubing joint 18, when it is disposed in suspended relation above the joint 22, it is placed on an inclined guy wire 26 for gravitational return to the pipe rack for subsequent use on other joints with the number of thread protectors being adequate to enable personnel to appropriately install the thread protector on the casing or tubing joint 18 before it is moved from the pipe rack and removed from the joint 18 and returned to the pipe rack so that there will always be a supply of thread protectors available for use and the installation and removal can be quickly and safely performed.

the thread protector 10 includes a tension belt generally designated by numeral 28, a resilient body encapsulating the tension belt and generally designated by numeral 30 with a latching device generally designated by numeral 32 being connected with the tension belt for use in clamping the thread protector to the casing or tubing joint 18 and enabling removal thereof in a manner described in detail hereinafter.

The tension belt 28 is in the form of a cold rolled steel sheet 34 which is rolled on a radius equal to the pipe diameter on which the thread protector is to be used in order to produce a spring force biasing the thread protector to open position thus eliminating the necessity of the thread protector to be held in open position by the person installing or removing the thread protector. The steel sheet 34 is heat treated to impart spring properties and is provided with a plurality of drilled holes 36 oriented in horizontal rows with the holes being staggered. The opposite ends of the steel sheet 34 are attached to a housing plate 38 and a handle box plate 40, respectively, by the use of rivets 42 extending through holes formed in the components, as illustrated in FIG. 6, in which the rivets 42 support the shear loads induced by the plates 38 and 40 and the tension belt 28 and retain the steel sheet 34 in rigid alignment with the plates.

The housing plate 38 is in the form of a stainless steel casting wih the inside radius being $\frac{1}{4}$ greater than the nominal pipe outside radius with the plate 38 includig an outwardly projecting, hollow rectangular housing 44 integral therewith and disposed adjacent to the end of the plate 38 remote from the rivets 42. The interior of the housing 44 is provided with a substantilly square hole 46 extending therethrough with the hole being perpendicular to a plane passing through the plates inside surface center of curvature. Similarly mounted within the opening 46 is a swivel member pivotally or swivelly supported from the top and bottom walls of the housing by shear pins or bolts 50 which extend through threaded apertures in the top and bottom walls of the housing 44 and into the upper and lower ends respectively of a passageway through the swivel member 48. As illustrated, the radially inner and outer surfaces of the swivel member 48 are radiused as at 52 to enable pivotal movement of the swivel member 48 with respect to the inner and outer surfaces of the hole or passageway 46 in the housing 44. The swivel member 48 also includes a passageway or hole 54 extending therethrough generally in perpendicular relation to the shear pins 50 which receive a yoke bolt 56 therethrough with the bolt 56 including a theaded end portion 58 on which is threaded a hexagonal nut 60 and a washer 62 in order to effectively adjust the length of the bolt 56, lock it is adjusted position and prevent the bolt 56 from pulling out of the swivel when loads are applied thereto with the nut being serrated at the outer end and self-locking. The other end of the bolt 56 is provided with a yoke 64 having a bifurcated end portion 66 with the yoke 64 being arcuately curved and of rectangular cross-sectional configuration. The bifurcated end 66 is pivotally connected to a link 68 by a roll pin 70 for a purpose described hereinafter with it being pointed out that the yoke 64 and bolt 56 bridges the ends of the plates 38 and 40 when the thread protector is in the clamped position and open position.

The handle box plate 40 has an inside radius $\frac{1}{4}''$ greater than the nominal pipe outside radius and includes a pair of generally parallel outwardly extending walls 72 which extend substantially throughout the length of the plate 40 with the ends of the walls 72 adjacent the rivets 42 being interconnected by an end wall 74 and the ends of the walls 72 adjacent the housing plate 38 including an end wall 76 in the form of a relatively thick casting which has a rectangular hole 78 extending therethrough which receives the rectangular yoke 64 to prevent rotation of the yoke bolt 56 and thus serves as a guide for the yoke 64 during reciprocation thereof through the opening 78 which is provided with a greater radial dimension than the radial dimension of the yoke 64 to enable restricted pivotal movement of the yoke 64 about the axis defined by the shear pins 50 which support the swivel member from the housing 44.

Pivotally supported between the walls 72 in spaced relation to the end walls 74 and 76 but closer to the end wall 76 is a handle 80 which at one end portion thereof and extending for a substantial portion of the length thereof includes a pair of parallel lugs 82 which extend over a substantial portion of the length thereof and have rounded ends 84 extending between the walls 72 and pivotally connected thereto by upper and lower pins 86 each of which extend only through one wall 72 and an adjacent lug 82, thus leaving the space between the lugs 82 unobstructed. Adjacent the inner ends of the lugs 82, the link 68 is pivotally connected between the lugs by a pivot bolt 88 having a countersunk head 89 thereon with a Phillips socket or recess therein to enable replacement with the pivot bolt 88 restricting the motion between the handle and link to rotation about an axis through the handle lugs. The portion of the link received between the lugs is provided with a dimension substantially equal to the distance between the lugs whereas the end of the link extending into the bifurcated end 66 of the yoke 64 is of reduced width to be received between the lugs defining the bifurcated end 66.

The end of the handle 80 remote from the pins 86 is reduced in dimension along the opposed surfaces thereof which are closest to the wall 72 when the handle is received therebetween, as designated by numeral 90. The radially outer surface of the handle 80 is provided with a recessed areas 92 which extends in the same general area as the recessed areas 90 with the radially inner surface of the handle and the outer surface of the handle being radiused along the same radius as the plate 40 and the outer edges of the walls 72 as illustrated clearly in FIG. 4. The terminal end portion of the handle 80 includes a radially outwardly extending member 94 generally radially perpendicular to the plate 40 when positioned adjacent thereto with the radially outer end portion of the terminal end 94 including a flange 96 which extends laterally to both sides of the reduced thickness radially outwardly extending portion 94 in order to enable a person to insert two fingers inwardly of the walls 72 and between the walls 72 and the outwardly extending portion 94 and under the flanges 96 to enable outward force to be exerted on the handle to swing it from the position illustrated in FIG. 4 to the position illustrated in FIG. 5. The outward pivoting or swinging movement of the handle 80 moves the pivot bolt 88 in an arcuate path about the center of rotation of the pins 86 thus causing pivotal movement of the link 68 and translatory movement of the link 68 and the yoke 64 with the pivot bolt 88 moving from a position radially inwardly of the pivot axis defined by the pivot pins 86 to a position radially outwardly thereof. When the handle 80 is in closed position, tension exerted on the bolt 56, yoke 64, pivot pins 70, link 68 and pivot bolt 88 will be inwardly of the pivot axis of the pivot pins 86 thus providing an over center latch which will stay closed until the handle 80 is swung outwardly so that the line of force between the bolt 56, yoke 64 and pivot bolt 88 will move outwardly of the pivot axis defined by the pins 86 so that the spring bias of the steel sheet 34 will cause the opening of the thread protector until the inner ends of the lugs 82 engage the outer surface of the plate 40 thus limiting the opening movement of the thread protector.

The flange 96 is provided with an inwardly extending and slightly inwardly curved hook 98 which, combined with the recess 92, produces a guide and hook structure for hooking the thread protector onto the guy wire 26 after it has been removed from the casing or tubing joint 18 for gravitational movement down the guy wire 26 in a well known manner.

The body 30 is constructed of molded neoprene of a bright red color to render it more visible and is resistant to various chemicals normally used in oil production and encapsulates the tension belt 28, the plates 38 and 40 with the end edges thereof extending beyond the end edges of the plates with the body including a unitary member 100 which includes internal threads 102, an inwardly extending flange 104 at one end thereof and rounded external corners 106 to facilitate the thread protector passing over objects or obstructions as the casing or tubing joint 18 is moving from the pipe rack to the rig. The overhanging lip or flange 104 does not extend inwardly of the interior of the pipe joint so that even if a thin wall casing joint is being used, a driftable gauge can still be moved through the pipe without interference from the thread protector. The threads 102 engage the threads on the casing joint 18 and serve to retain the thread protector in place when it is clamped to the pipe. The resilient body member 100 completely encloses the tension belt 28 and both portions of the plates 38 and 40 outwardly of the housing and walls with the body member 100 also including an angular recess or opening 108 providing access to the hexagonal nut 60 to enable adjustment of the yoke bolt and replacement if necessary. Also, passageways 110 are provided in the upper and lower edges of the body member 100 in alignment with the shear bolt 50 to enable removal and replacement thereof when necessary.

The thread protector can be adjusted with ordinary hand tools and can be serviced by similar tools with each shear bolt 50 including an Allen head socket which, of course, requires an Allen wrench. The exposed metal components are constructed of stainless steel which is corrosion resistant and the resilient body of neoprene as well as the exposed metal parts are resistant to various chemicals that are commonly used in oil well drilling operations. The capability of opening the latch device and removing the thread protector does not require that a person place his hand and arm between the casing joints, i.e., between the upper end of a casing already in the well bore and the lower end of a casing to be connected thereto since the hands and arms can be disposed radially outwardly of the thread protector at all times thus providing a safer operation. Also, the thread protector can be installed or removed without the use of any tools other than the hands of the person applying or removing the thread protector. The tension belt 28 being rolled on a radius equal to twice the normally closed radius provides adequate spring bias to open the thread prtector thus eliminating the necessity of the person opening the device to provide an opening force to the handle. With the thread protector in installed position, the fingers of the hand can be curved so that two fingers can be readily inserted beneath the flange to pull the handle outwardly thus opening the latch. When the over center structure passes the center on the opening movement, the thread protector will completely open and fall off of the casing joint or can be easily removed by using the palms of the hands at diametrically opposed points on the resilient body member 100. The spring bias toward open position requires ony a closing force to be exerted by the yoke bolt and swivel thereby preventing any sliding action between the yoke bolt and swivel thus reduced wear. It is pointed out that the rubber body member 100 extends slightly beyond the ends of the plates thus increasing the bond strength, stabilizing the plates and reduce rubber to metal separation. Also, the plates do not have any sharp edges which would tend to cut through the rubber body member when the weight of the casing joint is placed on the thread protector. Recessing the handle within the handle box formed by the walls 72, 74 and 76 prevents hang-ups on irregular surfaces and the handle incorporates the actuating flange as well as the hook which serves to accommodate guy wire delivery back to the pipe rack. The resilient body 100 will absorb shock without permanent deformation and will support the weight of one end of the casing joint without excessive deformation and the interior threads thereof retain the thread protector on the casing joint in a secure manner. The handle box formed by the radial walls prevents yoke bolt rotation, resists the hinge pins and maintains alignment of the handle, supports side loads which would tend to twist or break the yoke bolt, supports the handle in a manner necessary to maintain alignment of the components and protects the handle and other components from side loads when in use. The large surface area of the plates and the corresponding width of the tension belt serve to distribute loads over large areas and compress that portion of the resilient body 100 in contact with the threads of the casing joint. The various components other than belt 28 may be cast using conventional investment techniques and the like and all components are provided with adequate dimensional characteristics capable of providing the required strength characteristics for producing a thread protector which will be dependable in operation and long lasting.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A thread protector comprising an annular member having an axial line of separation to enable it to be installed on the threaded end of a pipe or the like, said annular member comprising an internal tension belt constructed of resilient material and shaped to bias the ends of the protector away from each other to open the protector when the ends of the belt are disconnected, means moving the ends of the belt towards each other for clamping the protector onto the threads and permitting the ends of the belt to move away from each other, said belt including a resilient body encapsulating the belt with said means being exposed for access, said means including a handle structure pivotally supported from the belt, a yoke bolt bridging the juncture between the ends of the belt and being connected to the end of the belt opposite from the handle, a link interconnecting the bolt and handle whereby pivotal movement of the handle will cam the ends of the belt towards each other for clamping engagement and movement of the pivotal connection between the bolt, link and handle past to center of the pivotal connection between the handle and belt will retain the handle in said protector clamping position and enable the opening bias of the belt to open the thread protector after the handle is moved outwardly over the pivot center of the pivotal connection between the handle and belt, said yoke bolt including means adjustably connecting the bolt to the belt, and adjustable means including a swivel connection between the yoke bolt and belt, said bolt extending through the swivel connection with a threaded nut adjusting the bolt in relation to the wivel connection, said belt including a sheet of metallic material having a pair of plates connected to the remote ends thereof with the plates being arcuate and the sheet of material being preformed to a radius greater than the radius of the pipe for spring biasing the protector to open position, said handle and link being disposed in a radially extending open box defined by spaced parallel side walls and end walls with the handle and link being completely received therein when in said protector clamping position.

2. The structure as defined in claim 1 wherein said handle includes an undercut end portion and a flange thereon by which the fingers of a person can be inserted under the flange to pivot the handle outwardly to a protector opening position.

3. The structure as defined in claim 2 together with an inwardly extending hook overlying the undercut portion of the handle to enable the handle and hook to be engaged on a downwardly inclined guy wire for returning the thread protector gravitationally to a point of application to a casing joint or the like.

4. The structure as defined in claim 3 wherein said resilient body is constructed of rubber or the like having a distinguishable bright red color and substantially completely encapsulating the sheet and plates except for the handle receiving box.

5. The structure as defined in claim 4 wherein said yoke bolt includes an arcuate portion of rectangular cross-sectional configuration, the end wall of the box adjacent the line of separation between the ends of the belt including a correspondingly shaped aperture receiving the yoke bolt to prevent rotation thereof while enabling reciprocation and limited inward and outward movement.

6. The structure as defined in claim 1 wherein said swivel connection includes a hollow housing integral with one of the plates connected to an end of the belt, a swivel member disposed in said hollow housing, shear pins extending inwardly throughout the sides of the housing into opposite sides of the swivel member to define a pivotal axis for the swivel member, said swivel member including a passageway therethrough for receiving one end of the yoke bolt, said shear pins terminating outwardly of the passageway to enable movement of the yoke bolt therethrough during adjustment of the yoke bolt, said threaded nut on the yoke bolt engaging the swivel member to adjust the yoke bolt in relation to the swivel member.

7. The structure as defined in claim 6 wherein said resilient body encapsulating the belt projects outwardly beyond the open box and housing with all of the components of the thread protector being inwardly of the peripheral surface of the body when the thread protector is in clamping position, the internal surface of the body including preformed threads to facilitate securing the thread protector to threads on the end of a pipe or the like, said body including a recess and a passageway enabling access to the adjustable nut on the end of the yoke bolt and the handle when received in the open box, said body also including passageways enabling access to the shear pins pivotally supporting the swivel member in the hollow housing to enable replacement thereof.

8. A threaded protector comprising an annular member having an axial line of separation to enable it to be installed on the threaded end of a pipe or the like, said annular member comprising a tension belt constructed of resilient material and shaped to bias the ends of the protector away from each other to open the protector when the ends of the belt are disconnected, means moving the ends of the belt towards each other for clamping the protector onto the threads on the pipe or the like and permitting the ends of the belt to move away from each other to remove the protector, said annular member including a resilient body encapsulating the belt with said means being exposed for access, said means including a handle pivotally supported from the belt, a yoke bolt bridging the juncture between the ends of the belt and being pivotally connected to the end of the belt opposite from the handle, a link pivotally connected to the bolt and handle whereby inward pivotal movement of the handle will move the ends of the belt toward each other for clamping the protector to the threads on the pipe with the pivotal connection between the bolt, link and handle moving inwardly past the center of the pivotal connection between the handle and belt thereby retaining the handle in said protector clamping position and outward pivotal movement of the handle moving the pivotal connection between the belt, link and handle outwardly past the center of the pivotal connection between the handle and belt whereby the opening bias of the belt will completely open the thread protector and retain it in open position, said yoke bolt including means adjustably connecting the bolt and belt, and means associated with said belt forming a protective boxlike recess with rigid peripheral walls receiving the handle, link and an end portion of the bolt when in clamping position.

* * * * *